US005382211A

United States Patent [19]

Solymosi

[11] Patent Number: 5,382,211

[45] Date of Patent: Jan. 17, 1995

[54] ROWING MACHINE

[76] Inventor: Frank Solymosi, Massapequa Park, N.Y.

[21] Appl. No.: 210,262

[22] Filed: Mar. 18, 1994

Related U.S. Application Data

[63] Continuation of Ser. No. 984,894, Dec. 2, 1992, abandoned.

[51] Int. Cl.[6] ..... A63B 69/06

[52] U.S. Cl. ..... 482/72; 482/73

[58] Field of Search ..... 434/247, 255; 482/73, 482/72; 472/728, 13, 14; 440/101, 102, 113

[56] References Cited

U.S. PATENT DOCUMENTS

| | | | |
|---|---|---|---|
| 604,164 | 5/1898 | Hinchcliffe | 472/13 |
| 2,586,024 | 2/1949 | Glasgow | 482/73 |
| 4,903,961 | 2/1990 | Solymosi | 482/73 |

FOREIGN PATENT DOCUMENTS

| | | | |
|---|---|---|---|
| 0127888 | 4/1950 | U.S.S.R. | 482/73 |
| 597799 | 3/1973 | U.S.S.R. | 482/73 |
| 1250316 | 8/1986 | U.S.S.R. | 482/73 |
| 1362486 | 12/1987 | U.S.S.R. | 482/72 |
| 1437048 | 11/1988 | U.S.S.R. | 482/73 |
| 1526706 | 12/1989 | U.S.S.R. | 482/73 |

*Primary Examiner*—Richard J. Apley
*Assistant Examiner*—Jerome Donnelly
*Attorney, Agent, or Firm*—Bauer & Schaffer

[57] ABSTRACT

There is disclosed an improved rowing apparatus which can accommodate a plurality of rowers at the same time and which permits simulating increased speeds in the water. The apparatus has an oblong tank having disposed on each side thereof and spaced therefrom in parallel relationship rowing attachments including seats, oarlocks and oars to accommodate a plurality of rowers.

4 Claims, 2 Drawing Sheets

ROWING MACHINE

This is a continuation of Ser. No. 07/984,894, filed Dec. 2, 1992, now abandoned.

This invention relates to rowing machine, and more particularly, to an improved training apparatus which accommodates a plurality of rowers at the same time and which permits simulating increased speeds in the water.

BACKGROUND OF THE INVENTION

In my U.S. Pat. No. 4,903,961 of Feb. 27, 1990 there is disclosed a rowing machine of the type in which a pair of generally oblong water-filled tanks straddle a third tank in which an oarsman sits and manipulates either a single or a pair of oars in one or both side tanks. Each of the side tanks is provided with fluid diverting means to enhance the water flow therein. The diverting means includes a central vertical wall separating the tank into the parallel sections and a plurality of horizontally oriented flow plates supported at each end of the tank connecting the two sections. When rowing, the rower pushes water in one section which then circulates within the tank being assisted in such movement by the diverting means. Such construction exhibited improved water action and wave motion over the then known apparatus of this type although only limited flow of water is obtained.

While the apparatus is highly effective as a training device and provides sufficient water flow to simulate a sense of movement, water resistance is, however, significantly larger than would be normally encountered by the rower in a river or lake. This resistance is largely the rower must push a relatively large body of stationary water and keep the water in motion. Moreover, an added problem exists because the diverting means used at each end of the tank and the solid center wall tends to produce water cavitation, as well as whirlpool and eddy effects, as the speed and rapidity of the rower's action increased.

In order to alleviate the foregoing disadvantages, an improved rowing apparatus was developed which is disclosed and claimed in my U.S. Pat. No. 5,306,219 issued Apr. 26, 1994. In this apparatus the oblong tanks are provided with a dividing wall assembly having a plurality of transverse passages acting to short circuit at least a portion of the water from one parallel section of the tank to another. In addition, the flow diverter is located at each end of the tank having a plurality of horizontally disposed, vertically spaced plates supported by a plurality of vertically oriented walls spaced parallel to each other between adjacently stacked pairs of plates which define a plurality of arcuate passages between the parallel section. While such construction provides improved water flow and reduced cavitation, it still does not provide for increased simulated speed, or natural water flow, again largely because a single rower pushes all the water in the tank. Moreover, neither of the previous apparatuses can be used to accommodate a plurality of rowers.

There exists, therefore, a need to provide a simplified construction which can be used by a plurality of rowers and which at the same time exhibits improved water flow and which permits simulating increased speeds in the water. The present invention fulfills such a need.

Other objects and advantages are stated in the foregoing disclosure of the present invention.

SUMMARY OF THE INVENTION

In accordance with the present invention there is provided an improved rowing machine for simultaneously accommodating a plurality of rowers and which permits increased water flow so that the rower is provided with a sense of increased speed in the water. The machine comprises a generally oblong tank having a bottom and opposed generally vertically extending side walls, the tank being fillable with water to a predetermined height and having a central longitudinal axis extending between first and second ends thereof, along which is set a vertically oriented divider wall, terminating short of the ends of the tank. A rower's bench is positioned on each side of the tank in spaced parallel relationship thereto; the rowing benches having a plurality of seats and oarlocks mounted thereon to accommodate in each a plurality of oarsmen who can extend their oars into the tank towards the central divider plate. As a consequence, a plurality of rowers can sit on either or both sides of the tank and by rowing in opposition to each other provide a true circular flow of water in the tank at speeds not obtained previously.

Full details of the present invention are set forth in the following description.

DESCRIPTION OF THE DRAWINGS

The accompanying drawings are to be taken in conjunction with the detailed description of the invention set forth hereinbelow. In the drawings.

DESCRIPTION OF THE PREFERRED EMBODIMENTS

Figure 1:
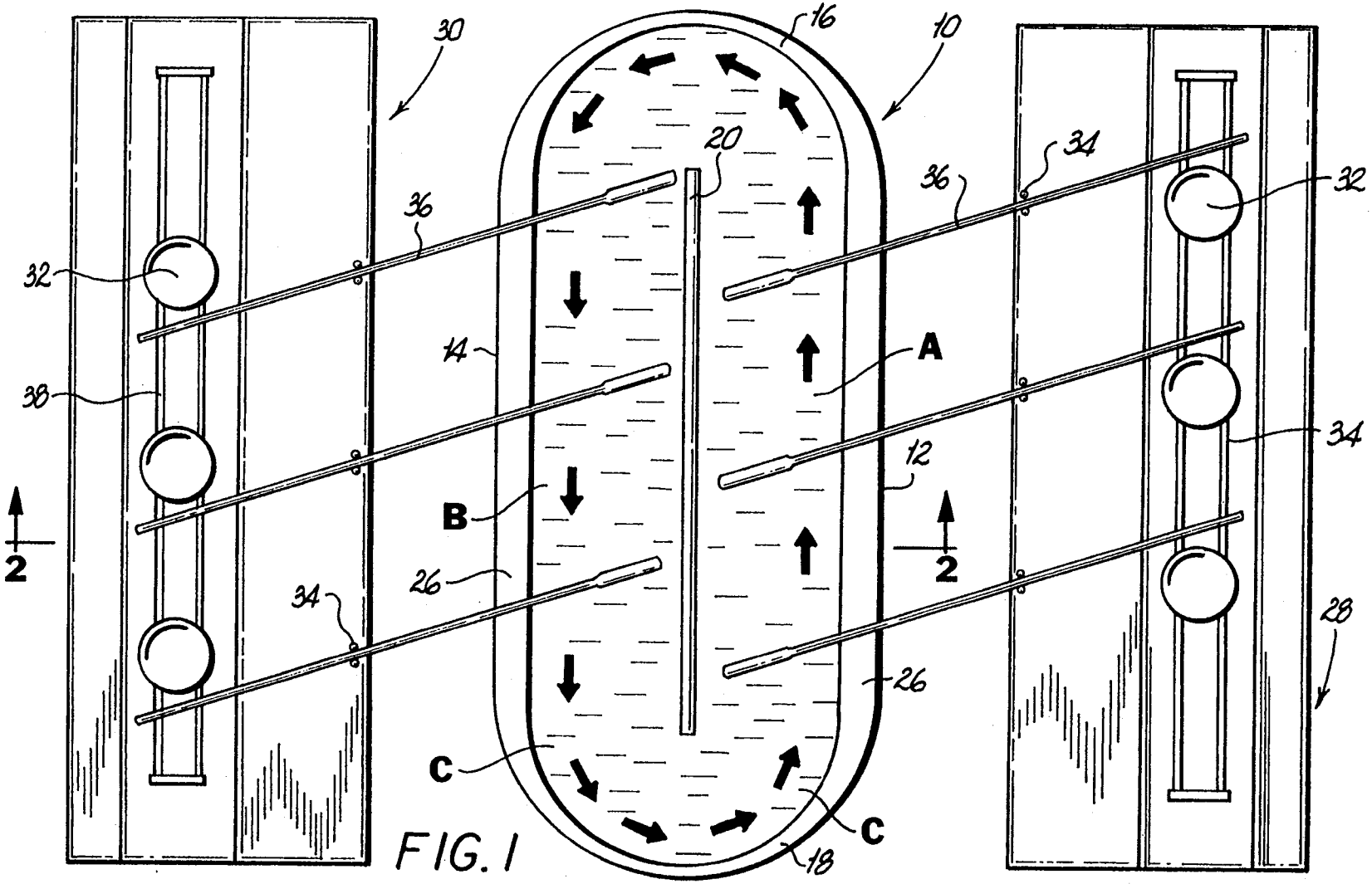
FIG. 1 is a diagrammatical plan view of a rowing training apparatus according to the invention.

Referring now more particularly to the drawing, the improved rowing machine comprises an oblong tank 10 which is normally filed with a predetermined amount of water. The tank is provided with parallel side walls 12 and 14, first and second semi-circular ends 16 and 18, respectively, as well as a bulkhead 20 which extends from the bottom of the tank between the first and second ends and along the central longitudinal axis of the tank. In general, the construction of the tank may embody the specific elements shown in my aforementioned patent and patent application, in whole or in any combination of structures disclosed. For example, the simple central divider shown in my patent, and/or with the multi-passage, horizontal end diverter assembly of the co-pending application may be employed as desired. Accordingly, the subject disclosure of my earlier patents are incorporated herein as if more fully set forth.

The tank 10 is provided with a bottom 22 having an upper surface 24 which slopes downwardly from the side walls towards the bottom of the bulkhead 20. The solid bottom with sloping surface allows less water to be used thus reducing the weight of the entire apparatus. This inner body is not, however, crucial and the bottom may be formed in other ways if desired. That is, the bottom may be formed flat, arcuate or otherwise provided ample room is left for oar movement adjacent the center divider.

Figure 2:
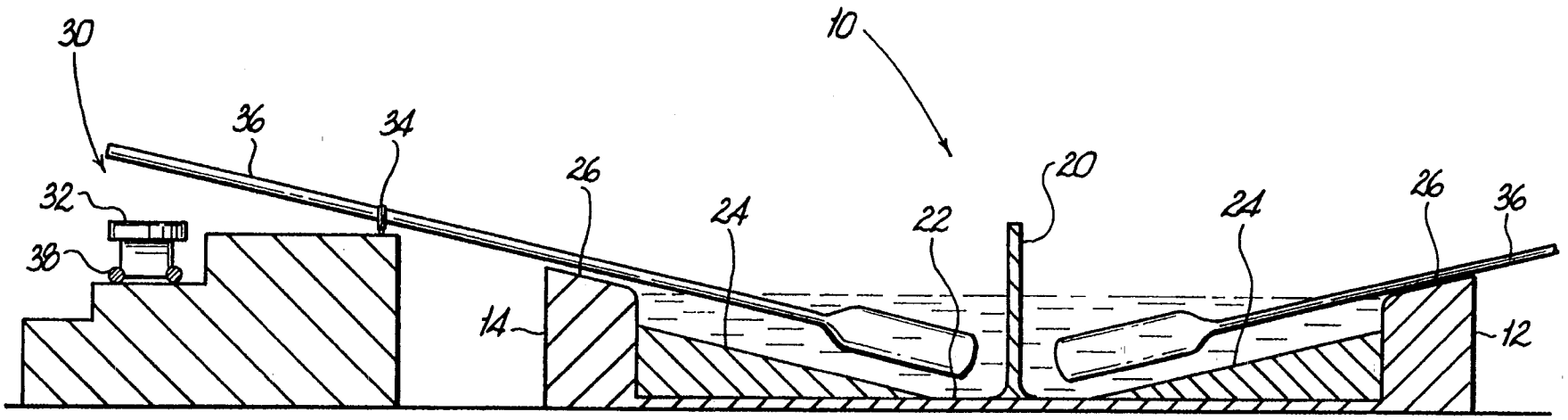
FIG. 2 is a diagrammatical lateral sectional view taken across line 2—2 of FIG. 1.

As seen in FIG. 2, the side walls are preferably formed with an outwardly directed lip 26 which acts as a splash preventing wall, maintaining the area about the tank free of water even during violent use. The lip 26 is slightly inclined toward the tank not only to cause water to flow back into the tank, but to form a non-destructive rest for the oars when they are being manipulated.

A pair of rower's benches 28 and 30, respectively, are positioned on each side of the oblong tank 10. Each of these benches have a plurality of seats 32 preferably movable (although fixed seats can be used) located thereon, as well as a plurality of oarlocks 34 (FIG. 2) in each of which an oar 36 is mounted to extend into the tank 10 towards the central dividing bulkhead 20. The moveable seats are preferably mounted on rails 38 provided with customary stop means limiting movement in the forward and rearward directions.

As is evident from the drawings, a plurality of rowers sitting on opposite sides of the tank will move the water in opposing directions indicated by the arrows A and B. The action of the rowers is cooperatively turning both sides of tank into dynamic flow sections. The action of the rowers results in a continuous circular flow of water round the central bulkhead, as indicated by the arrow C. In effect, one set of rowers pushes the water in its section of the tank, while the other pulls the water in its section. This positive flow action in both halves or sections of the tank permits the attainment of increase in speed of water flow of about a 10-fold or more, and provides each rower with a sense of increased movement through the water approximating the natural speeds obtained in the open river or water.

It will, of course, be apparent that the present invention may be incorporated in any of the structures disclosed in my earlier patents, as well as in other structures common in this art. The ability, through the present structure, of enabling several rowers to train at the same time is quite advantageous since by and large rowing is a team sport. Therefore, the more the rowing crew can operate together, the better and more cohesive a team the crew becomes. In the present apparatus, an entire crew can train as if they were aligned in a single boat with alternate right and left handed rowers sitting on opposite benches, yet coordinated both in physical proximity and rowing action with each other. By merely exchanging places, side to side, each member of the crew may exercise both left and right hand rowing.

The economic advantages of the present invention are also obvious. The number of rowers is increased, while the number of water tanks (the costliest structure) is reduced.

Various features shown in my earlier patents may be used as well with the present invention. For example, a safety and splash cover may be applied on the outside half of the tank. The tanks may be reinforced and set on a concrete foundation for added safety.

While several of the embodiments and examples of the present invention have been illustrated and described, it is obvious that many changes and modifications may be made thereunto, without departing from the spirit and scope of the invention.

What is claimed is:

1. Apparatus for training rowers comprising an oblong tank formed of a bottom wall and a continuous vertical peripheral wall, said tank being filled with a body of water, a central bulkhead extending fixedly from said bottom upwardly along the longitudinal axis of said tank, the ends of said bulkhead being spaced from the wall of said tank to separate the body of water in said tank into two parallel sections and to provide a passageway around the end of said bulkhead connecting said sections, a rowing bench positioned exterior of the peripheral wall of said tank of each of the longitudinal sides of said tank in spaced parallel relationship, each rowing bench having a plurality of seats and associated oarlocks mounted thereto, a plurality of oars mountable within said oar locks and extending into said tank toward said central bulkhead, wherein each of said oars are positioned on their respective sides of said bulkhead, said seats being arranged on said benches so that the rowers on one bench manipulate the oars in a direction opposed to the manipulation of the oars by those rowers on the other bench relative to the bulkhead to cause the flow of water created by the rowing to take a continuous circular path about the sections of the tank.

2. The apparatus according to claim 1 wherein the bottom wall slopes downwardly in cross section from peripheral wall toward the central bulkhead.

3. The apparatus according to claim 1 wherein said peripheral wall is formed with an outwardly extending lip for preventing splash of water out of said tank.

4. The apparatus according to claim 1 wherein the rowers' benches each comprise an elongated platform raised above the level of the peripheral wall on which said seats and oarlocks are secured, each said platform being arranged so that the seats extend in alignment with the central bulkhead, and are mounted on tracks extending along the length of the platform, said seats being slidable forwardly and rearwardly along said tracks.

* * * * *